US009213299B2

(12) United States Patent
Tanaka

(10) Patent No.: US 9,213,299 B2
(45) Date of Patent: Dec. 15, 2015

(54) SLIDING MEMBER FOR IMAGE FORMING APPARATUS, CLEANING DEVICE, PROCESS CARTRIDGE, AND IMAGE FORMING APPARATUS

(71) Applicant: FUJI XEROX CO., LTD., Tokyo (JP)

(72) Inventor: Daisuke Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/598,774

(22) Filed: Jan. 16, 2015

(65) Prior Publication Data

US 2015/0253721 A1 Sep. 10, 2015

(30) Foreign Application Priority Data

Mar. 7, 2014 (JP) ..... 2014-045653

(51) Int. Cl.
*G03G 21/00* (2006.01)

(52) U.S. Cl.
CPC ..... *G03G 21/0017* (2013.01)

(58) Field of Classification Search
CPC ..... G03G 21/0011; G03G 21/0017; G03G 2215/1661
See application file for complete search history.

(56) References Cited

U.S. PATENT DOCUMENTS 6,633,739 B2 * 10/2003 White et al. ..... 399/353
7,769,337 B2 * 8/2010 Itoh et al. ..... 399/350

FOREIGN PATENT DOCUMENTS

| | | | | |
|---|---|---|---|---|
| JP | S6490484 | A | | 4/1989 |
| JP | H09160457 | A | | 6/1997 |
| JP | 2001343874 | A | | 12/2001 |
| JP | 2003103686 | A | * | 4/2003 |
| JP | 2004279734 | A | | 10/2004 |
| JP | 2005274952 | A | | 10/2005 |
| JP | 2013080077 | A | | 5/2013 |

* cited by examiner

*Primary Examiner* — Gregory H Curran
(74) *Attorney, Agent, or Firm* — Oliff PLC

(57) ABSTRACT

A sliding member for image formation which is disposed in an image forming apparatus, includes a base material, the entirety of which contains a resin and which further has a carbon-containing region containing carbon, which has an sp3 bond, on a contact side with a contacted member, and in which a region other than the carbon-containing region is formed of an identical material, wherein the sliding member satisfies any one of the requirements of the following (A) and (B): (A) the carbon-containing region configures a contact portion with the contacted member; and (B) the sliding member is provided with a carbon layer which does not contain a resin but contains carbon having an sp3 bond on a surface further on the contact side with the contacted member of the carbon-containing region and configures a contact portion with the contacted member.

20 Claims, 5 Drawing Sheets

SLIDING MEMBER FOR IMAGE FORMING APPARATUS, CLEANING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-045653 filed Mar. 7, 2014.

BACKGROUND

1. Technical Field

The invention relates to a sliding member for an image forming apparatus, a cleaning device, a process cartridge, and an image forming apparatus.

2. Related Art

An image forming apparatus of an electrophotographic system is provided with a cleaning device for cleaning developer remaining in an image holding member, an intermediate transfer belt, or the like. As the cleaning device, an elastic cleaning blade using a resin such as polyurethane rubber as a base material is commonly used. The cleaning blade is provided such that a corner (edge) contacts with a contacted member and scrapes the developer using the edge through sliding. In addition to the cleaning blade, the image forming apparatus also includes a sliding member that is used in a mode in which the sliding member is disposed so as to contact with other members and slides.

SUMMARY

According to an aspect of the invention, there is provided a sliding member for image formation which is disposed so as to slide while contacting with at least a contacted member in an image forming apparatus, including:

a base material, the entirety of which contains a resin and which further has a carbon-containing region containing carbon, which has an sp3 bond, on a contact side with the contacted member, and in which a region other than the carbon-containing region is formed of an identical material, wherein the sliding member satisfies any one of the requirements of the following (A) and (B):

(A) the carbon-containing region configures a contact portion with the contacted member; and (B) the sliding member is provided with a carbon layer which does not contain a resin but contains carbon having an sp3 bond on a surface further on the contact side with the contacted member of the carbon-containing region and configures a contact portion with the contacted member.

BRIEF DESCRIPTION OF THE DRAWINGS

Exemplary embodiments of the present invention will be described in detail based on the following figures, wherein.

DETAILED DESCRIPTION

Figure 1:
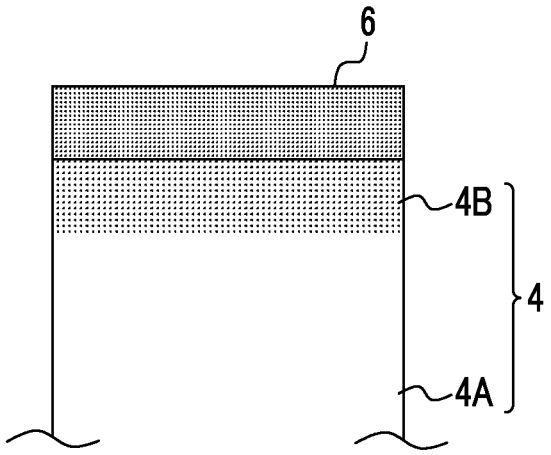
FIG. 1 is a schematic view showing an example of a sliding member according to an exemplary embodiment.

Hereinafter, exemplary embodiments of an image forming apparatus and a process cartridge of the invention will be described.

Sliding Member for Image Forming Apparatus

A sliding member for an image forming apparatus according to an exemplary embodiment (hereinafter, simply referred to as "sliding member") is a sliding member which is disposed so as to slide while contacting with at least a contacted member in the image forming apparatus.

The sliding member at least has a base material, the entirety of which contains a resin. In addition, the base material further has a carbon-containing region containing carbon, which has an sp3 bond, on a contact side with the contacted member.

Furthermore, the sliding member satisfies anyone of the requirements of the following (A) and (B).

(A) The carbon-containing region configures a contact portion with the contacted member.

(B) The sliding member is provided with a carbon layer which does not contain a resin but contains carbon having an sp3 bond on a surface further on the contact side with the contacted member of the carbon-containing region and configures a contact portion with the contacted member.

In the sliding member according to a first exemplary embodiment in the exemplary embodiments, a region other than the carbon-containing region in the base material is formed of an identical material.

In addition, in the sliding member according to a second exemplary embodiment in the exemplary embodiments, the resin contained in the base material does not have a crosslinking structure by isocyanate.

Here, in some cases, in a cleaning blade which is a type of the sliding member used in a mode in which the sliding member is disposed so as to contact with a contacted member in the image forming apparatus and slides, a measure is taken in which a base material such as a polyurethane resin is subjected to a curing treatment using an isocyanate compound in order to provide a low friction property. That is, a measure is taken in which only a contact portion (edge portion) with the contacted member is subjected to the curing treatment through a reaction with the isocyanate compound.

In a case of an image forming apparatus using a two-component development system, there is a situation in which some iron powder used in frictional electrification of toner rushes to the edge portion of the cleaning blade. When the contact portion (edge portion) with the contacted member is subjected to the curing treatment, flexibility of the edge portion deteriorates, and for example, the edge portion becomes delicate with respect to a concentration of local stress caused by a collision with the iron powder or with other end portions of paper, and therefore, chipping occurs in a portion of the edge portion.

In contrast, the sliding member according to an exemplary embodiment further has a carbon-containing region containing carbon, which has an sp3 bond, on a contact side with the contacted member of the base material containing a resin. In addition, in the first exemplary embodiment, a region other than the carbon-containing region in the base material is formed of an identical material. In contrast, in the second exemplary embodiment, the resin contained in the base material does not have a crosslinking structure by isocyanate. With such a configuration, the low sliding property or wear resistance possessed by the carbon component which has an sp3 bond coexists with the toughness (flexibility) possessed by the resin component in the carbon-containing region, and a more stable contact condition is maintained for a long period of time while preventing chipping against a concentration of local stress caused by collision with foreign matters such as iron powder.

In view of further enhancing the low sliding property at an early stage, it is more preferable that the base material further has a carbon layer which does not contain a resin but contains carbon having an sp3 bond on a surface on the contact side with the contacted member of the carbon-containing region of the base material, that is, the base material satisfies the requirement of the above-described (B). However, the above-described carbon layer may have characteristics in that the carbon layer is more likely to be peeled off as the sliding performance is more strongly performed, and thereby the friction force increases. Moreover, there is a tendency that the carbon layer vanishes as is continuously used. However, there is a base material having a carbon-containing region in the exemplary embodiment, and therefore, the low sliding property and the wear resistance are maintained even after the carbon layer vanishes.

Next, the configuration of a sliding member according to the exemplary embodiment will be described in detail.

The sliding member according to the exemplary embodiment at least has a base material 4 as shown in FIG. 1, and the base material 4 further has a carbon-containing region 4B containing carbon, which has an sp3 bond, on a contact side with a contacted member. In the sliding member according to the first exemplary embodiment, the entire region 4A other than the carbon-containing region in the base material 4 is formed of an identical material. In contrast, in the sliding member according to the second exemplary embodiment, a resin contained in the base material 4 does not have a crosslinking structure by isocyanate.

In addition, the above-described sliding member may further include a carbon layer 6, which dost not contain a resin but contains carbon having an sp3 bond, on the surface on a contact side with the contacted member of the carbon-containing region 4B. In this case, the carbon layer 6 may configure the contact portion with the contacted member. In contrast, in a case where the sliding member is not provided with the carbon layer 6, the carbon-containing region 4B configures the contact portion with the contacted member.

The sliding member according to the exemplary embodiment is disposed so as to slide while contacting with at least the contacted member in the image forming apparatus.

Here, a mode in which the above-described sliding member is used as a cleaning blade will be described using the drawing. Hereinafter, as shown in FIG. 2, the cleaning blade (sliding member) has a contact portion (contact angle portion or edge portion) 3A which contacts with a driving image holding member (photoconductor drum) 31 and cleans the surface of the image holding member 31; a tip end surface 3B in which the contact angle portion 3A configures one side of the cleaning blade and which faces an upstream side in a direction (arrow A direction) of the driving; a ventral surface 3C in which the contact angle portion 3A configures one side of the cleaning blade and which faces a downstream side in a direction (arrow A direction) of the driving; and a back surface 3D which shares one side with the tip end surface 3B and faces the ventral surface 3C.

In addition, the direction parallel to the contact angle portion 3A is referred to as a depth direction, the direction on a side on which the tip end surface 3B is formed, from the contact angle portion 3A is referred to as a thickness direction, and the direction on a side on which the ventral surface 3C is formed, from the contact angle portion 3A is referred to as a width direction.

Figure 2:
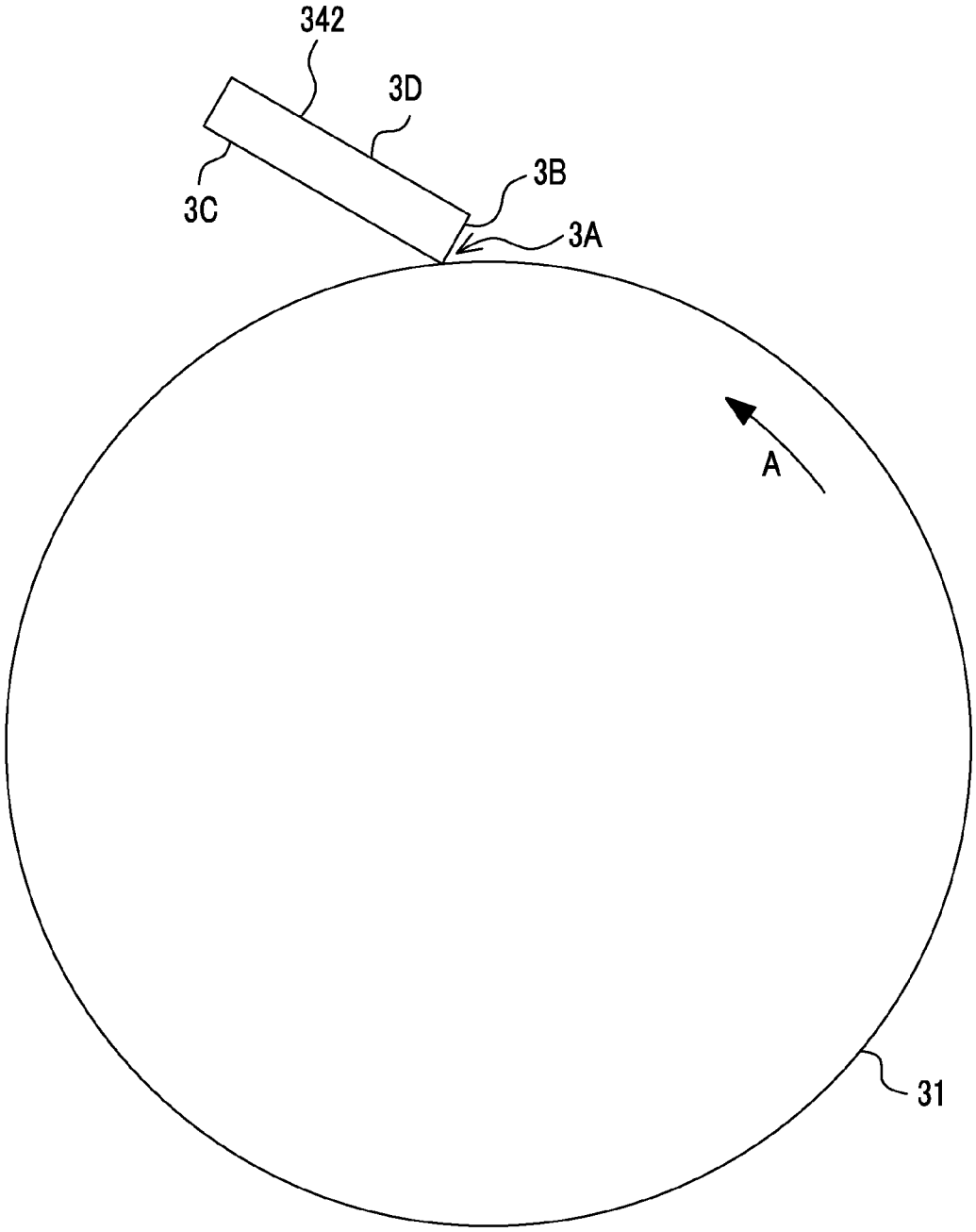
FIG. 2 is a schematic view showing an example of a cleaning blade using the sliding member according to the exemplary embodiment.

The direction in which the image holding member (photoconductor drum) 31 is driven is drawn as the arrow A in FIG. 2 for convenience, but FIG. 2 shows a state in which the image holding member 31 stops.

Figure 3:
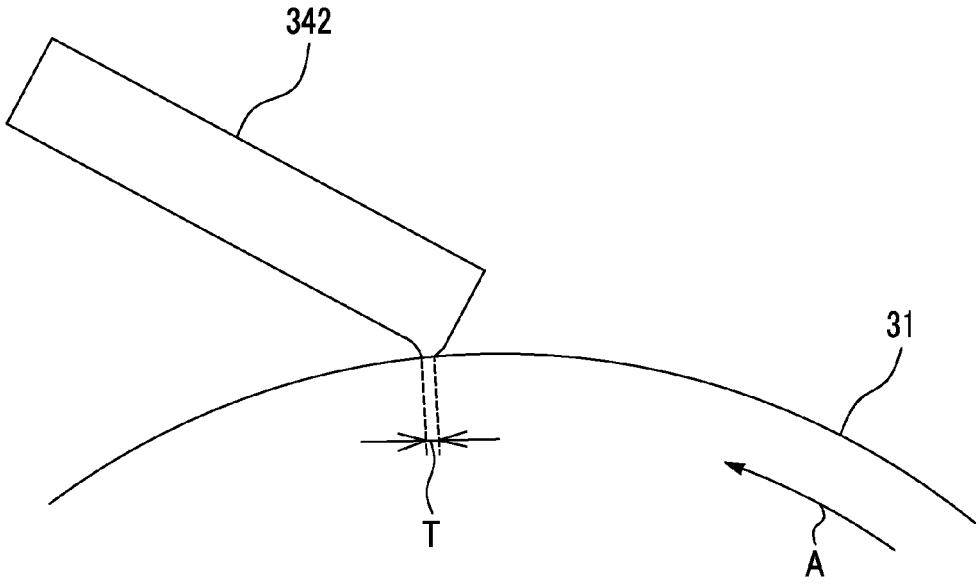
FIG. 3 is a schematic view showing a state in which the cleaning blade according to the exemplary embodiment contacts with a driven image holding member.

The cleaning blade (sliding member) according to the present embodiment is disposed so as to contact with the surface of the image holding member (member to be slid) 31 as shown in FIG. 2. When the image holding member 31 is driven, as shown in FIG. 3, a sliding motion occurs in the contact portion between a cleaning blade 342 and the image holding member 31, a nip portion T is formed, and the surface of the image holding member 31 is cleaned.

(Base Material)

Resin

The entire base material in the sliding member according to the exemplary embodiment contains a resin.

Rubber is preferable as the resin, and examples thereof include polyurethane rubber, silicon rubber, fluorine rubber, propylene rubber, and butadiene rubber. Particularly, polyurethane rubber is preferable and highly crystallized polyurethane rubber is more preferable.

In general, polyurethane rubber is synthesized by polymerizing polyisocyanate and a polyol. In addition, a resin having a functional group capable of reacting with an isocyanate group other than the polyol may be used. It is preferable that polyurethane rubber have a hard segment and a soft segment.

Here, the "hard segment" and the "soft segment" mean segments in which the material constituting the former is formed of a relatively hard material than the material constituting the latter, and the material constituting the latter is formed of a relatively soft material than the material constituting the former, among polyurethane rubber materials.

In addition, the above-described "polyisocyanate" does not form a crosslinking structure in the synthesized resin, that is, the above-described "crosslinking structure by isocyanate" in the sliding member according to the second exemplary embodiment is not formed.

The combination of the material (hard segment material) constituting the hard segment and the material (soft segment material) constituting the soft segment is not particularly limited. Any well-known resin material may be selected such that a combination, in which one material is relatively harder than the other material, and the other material is comparatively softer than the one material, is obtained. In the exemplary embodiment, the following combination is suitable.

Soft Segment Material

First, examples of the soft segment material include, as the polyol, a polyester polyol obtained through dehydration condensation of a diol and dibasic acid, polycarbonate polyols obtained through the reaction of the diol with alkyl carbonate, polycaprolactone polyols, and polyether polyols. Examples of the commercially available polyol used as the soft segment material include Placcel 205 and Placcel 240 manufactured by Daicel Chemical Industries.

Hard Segment Material

In addition, as the hard segment material, it is preferable to use a resin having a functional group capable of reacting with an isocyante group. In addition, it is preferable that the resin be flexible and the resin be an aliphatic resin having a linear chain in terms of the flexibility. Specifically, it is preferable to use an acrylic resin containing two or more hydroxyl groups, a polybutadiene resin containing two or more hydroxyl groups, and an epoxy resin having two or more epoxy groups.

Examples of the commercially available acrylic resin containing two or more hydroxyl groups include Act Flow (grades: UMB-2005B, UMB-2005P, UMB-2005, UME-2005, or the like) manufactured by Soken Chemical Engineering Co., Ltd.

Examples of the commercially available polybutadiene resin containing two or more hydroxyl groups include R-45HT manufactured by Idemitsu Kosan Co., Ltd.

As the epoxy resin having two or more epoxy groups, it is preferable to use an epoxy resin having more flexible toughness than an epoxy resin in the related art instead of using a general epoxy resin in the related art which has characteristics such as hard and delicate. An epoxy resin having a structure (flexible skeleton) which may increase mobility of a main chain in its main chain structure in terms of a molecular structure is suitable, and examples of the flexible skeleton include an alkylene skeleton, a cycloalkane skeleton, and a polyoxyalkylene skeleton, and the polyoxyalkylene skeleton is particularly suitable.

In addition, in terms of physical properties, an epoxy resin having lower viscosity compared to the molecular weight is suitable compared to the epoxy resin in the related art. Specifically, it is preferable that the weight average molecular weight be within a range of 900±100 and the viscosity at 25° C. be within a range of 15000 mPa·s±5000 mPa·s, and it is more preferable that the viscosity at 25° C. be within a range of 15000 mPa·s±3000 mPa·s. Examples of the commercially available epoxy resin having such characteristics include EPLICON EXA-4850-150 manufactured by DIC Corporation.

When using the hard segment material and the soft segment material, the weight ratio (hereinafter, referred to as "hard segment material ratio") of the material constituting the hard segment with respect to the total amount of the hard segment material and the soft segment material is preferably within a range of 10% by weight to 30% by weight, more preferably within a range of 13% by weight to 23% by weight, and even more preferably 15% by weight to 20% by weight.

The wear resistance may be obtained by having a hard segment material ratio of greater than or equal to 10% by weight. In contrast, the flexibility and the extensibility may be obtained and the generation of chipping may be prevented by having a hard segment material ratio of less than or equal to 30% by weight.

Polyisocyanate

Examples of the polyisocyanate used in the synthesis of polyurethane rubber include 4,4'-diphenylmethane diisocyanate (MDI), 2,6-toluene diisocyanate (TDI), 1,6-hexane diisocyanate (HDI), 1,5-naphthalene diisocyanate (NDI), and 3,3-dimethylphenyl-4,4-diisocyanate (TODI).

In terms of easily forming hard segment aggregates with a required size (particle diameter), 4,4'-diphenylmethane diisocyanate (MDI), 1,5-naphthalene diisocyanate (NDI), and hexamethylene diisocyanate (HDI) are more preferable as the polyisocyanate.

The blending amount based on 100 parts by weight of a resin having a functional group capable of reacting with an isocyanate group of polyisocyanate is preferably 20 parts by weight to 40 parts by weight, more preferably 20 parts by weight to 35 parts by weight, and even more preferably 20 parts by weight to 30 parts by weight.

When the blending amount thereof is greater than or equal to 20 parts by weight, a large bonding amount of urethane is ensured and the hard segment grows, and thereby it is possible to obtain required hardness. In contrast, when the blending amount thereof is less than or equal to 40 parts by weight, the hard segment is not increased excessively, and thereby it is possible to obtain extensibility and to prevent the generation of chipping of the sliding member.

Crosslinking Agent

Examples of the crosslinking agent include a diol (bifunctional), and a triol (trifunctional) tetraol (tetrafunctional), and these may be used in combination. In addition, an amine compound may be used as the crosslinking agent. A tri- or higher functional crosslinking agent is preferably used in crosslinking. Examples of the trifunctional crosslinking agent include trimethylolpropane, glycerin, and triisopropanolamine.

The blending amount based on 100 parts by weight of a resin having a functional group capable of reacting with the isocyanate group of the crosslinking agent is preferably less than or equal to 2 parts by weight. When the blending amount thereof is less than or equal to 2 parts by weight, the molecular movement is not restricted by the chemical crosslinking and the hard segment derived from the urethane bonding grows greatly by maturing, and therefore, the required hardness may be easily obtained.

Method of Forming Base Material (Base Material Before Forming Carbon-Containing Region)

In producing the base material (base material before forming a carbon-containing region) entirely containing polyurethane rubber which is one type of the resin, a general method of producing polyurethane, such as a prepolymer method or a one-shot method may be used. It is possible to obtain polyurethane excellent in strength and wear resistance through the prepolymer method, which is suitable for the exemplary embodiment, but production method is not limited.

The polyurethane rubber is formed by blending and mixing a polyisocyanate compound, crosslinking agent, and the like with the above-described polyol. The formation of the base material before forming the carbon-containing region is implemented by forming a base material-forming composition which is manufactured through, for example, the above-described method into a sheet shape through centrifugal molding or extrusion molding, and by subjecting the composition to cutting processing.

Here, an example of the method of producing the base material before forming the carbon-containing region will be described in detail.

First, a soft segment material (for example, a polycaprolactone polyol) and a hard segment material (for example, acrylic resin containing two or more hydroxyl groups) are mixed (for example, at a weight ratio of 8:2).

Next, an isocyanate compound (for example, 4,4'-diphenylmethane diisocyanate) is added to the mixture of the soft segment material and the hard segment material, and the mixture is reacted in a nitrogen atmosphere, for example. The temperature at this time is preferably 60° C. to 150° C. and more preferably 80° C. to 130° C. In addition, the reaction time is preferably 0.1 hour to 3 hour and more preferably 1 hour to 2 hour.

Subsequently, the isocyanate compound is further added thereto, and the mixture is reacted in a nitrogen atmosphere to obtain a prepolymer, for example. The temperature at this time is preferably 40° C. to 100° C., more preferably 60° C. to 90° C. In addition, the reaction time is preferably 30 minutes to 6 hours and more preferably 1 hour to 4 hours.

Next, the temperature of the prepolymer is raised and the prepolymer is defoamed under reduced pressure. The temperature at this time is preferably 60° C. to 120° C. and is more preferably 80° C. to 100° C. In addition, the reaction time is preferably 10 minutes to 2 hours and more preferably 30 minutes to 1 hour.

Then, a crosslinking agent (for example, 1,4-butanediol or trimethylolpropane) is added to the prepolymer, and a thixotropic composition is further mixed therewith to prepare a base material-forming composition.

Next, the above-described base material-forming composition is poured into a mold of a centrifugal molding machine and is subjected to a curing reaction. The temperature of the mold at this time is preferably 80° C. to 160° C. and more preferably 100° C. to 140° C. In addition, the reaction time is preferably 20 minutes to 3 hours and more preferably 30 minutes to 2 hours.

The composition is further subjected to a crosslinking reaction and is cooled, and then, the base material before forming the carbon-containing region is formed by cutting the cooled composition. The temperature for maturing and heating during the crosslinking reaction is preferably 70° C. to 130° C., more preferably 80° C. to 130° C., even more preferably 100° C. to 120° C. In addition, the reaction time is preferably 1 hour to 48 hours and more preferably 10 hours to 24 hours.

Physical Properties

As the resin contained in the base material, rubber having a JIS-A hardness of less than or equal to 85 degrees is preferable. The hardness thereof is more preferably 70 degrees to 85 degrees and even more preferably 73 degrees to 82 degrees.

The above-described JIS-A hardness is measured through the following method.

The hardness is measured through a test method using a durometer with which the hardness from the indentation depth when a press needle having a shape determined by a surface of a rubber sample is pressed through a spring.

When the resin contained in the base material is polyurethane rubber, the weight average molecular weight of the polyurethane rubber is preferably within a range of 1000 to 4000 and more preferably within a range of 1500 to 3500.

(Carbon-Containing Region and Carbon Layer in Base Material)

The base material according to the exemplary embodiment further has a carbon-containing region containing carbon, which has an sp3 bond, on a contact side with the contacted member. The method of forming the carbon-containing region is not particularly limited, but examples thereof include a method of penetrating carbon atoms having a sp3 bond into the base material by directly implanting plasma ions into the base material containing a resin.

In addition, the sliding member according to the exemplary embodiment may further include a carbon layer, which does not contain a resin but contains carbon having a sp3 bond, on the surface on a contact side with the contacted member of the carbon-containing region. The method of forming the carbon layer is not also particularly limited, but examples thereof include a method of stacking carbon, which has a sp3 bond, to the outside of the carbon-containing region by adjusting the time for implanting ions when forming the carbon-containing region through the above-described method of directly implanting plasma ions.

Formation of Carbon-Containing Region and Carbon Layer Through Pulse Plasma Ion Implantation Method Here, a pulse plasma ion implantation method through which a carbon-containing region and a carbon layer may be formed in the base material will be described.

In the pulse plasma ion implantation method, the carbon-containing region is formed on a contact side with a contacted member of the base material through a composite process in which an ion implantation process and a film formation process are combined by pulse plasma using at least one or more gases for ion implantation, and the carbon layer is formed on the surface on the contact side with the contacted member of the carbon-containing region. In addition, a surface adjusting process using pulse plasma may be provided before the above-described composite process.

In the carbon-containing region formed in this way, resin and carbon which has an sp3 bond are bonded by selecting the type of the resin in the base material, and diamond-like carbon (DLC) is formed. In addition, in the carbon layer formed through the above-described method, carbon having an sp3 bond is stacked and DLC layer is formed.

Here, the formation method will be described in more detail.

A high frequency power source for plasma generation and a power source for high voltage pulse generation are connected to abase material within a chamber through a common feedthrough, and a high frequency pulse (pulse RF voltage) is applied to the base material from the high frequency power source for plasma generation to generate plasma to the periphery along the external form of the base material. Then, in plasma or afterglow plasma, a negative high voltage pulse (DC pulse voltage) is applied to the base material at least once from the source for high voltage pulse generation, and application of the high frequency pulse and application of the negative high voltage pulse are repeatedly performed. The number of times of repeating the application of the high frequency pulse and the application of the high voltage pulse is preferably within a range of 100 times/second to 5000 times/second.

It is preferable that the high frequency pulse width be set to a short pulse of 2 μs to 200 μs and the high voltage pulse width be set to a short pulse of 0.2 μs to 50 μs. the high voltage pulse is applied after the lapse of 10 μs to 300 μs after the application of the high frequency pulse.

As the gas used in the surface adjusting process, a mixed gas containing argon and methane, and further containing hydrogen is used.

When forming the carbon layer, a methane gas is suitably used as the gas for pulse plasma ion implantation. Examples of the gas for film forming gas include one or more gases selected from the group consisting of acetylene, propane, butane, hexane, benzene, chlorobenzene, and toluene.

The carbon-containing region may be formed inside the base material while preventing the treatment temperature within a range of 50° C. to 100° C. by implanting plasma ions at least containing Si ions and C ions, which are isolated in the vicinity of the surface of the base material through application of high voltage pulse, into the base material in a state of being excited in kinetic energy of 5 keV to 30 keV, for example. In addition, a DCL layer, that is, the carbon layer may be piled on the surface of the carbon-containing region within a range of 0.2 μm to 1.0 μm.

In addition, the carbon-containing region and the carbon layer may further contain N atoms and F atoms in addition to C atoms or Si components which having a sp3 bond, as the components.

Fixation of powder due to frictional electrification is prevented in the sliding member by containing the N atoms. In addition, release properties of the sliding portion in the sliding member are improved and the fixation of powder is prevented by containing the F atoms.

Examples of the gas for implantation used when the N atoms are contained include a gas in which argon, hydrogen, oxygen and an ammonia gas are mixed together.

In addition, examples of the gas for implantation used when the F atoms are contained include a gas in which hexamethyldisiloxane (HMDSO) and acetylene ($C_2H_2$), and carbon fluoride ($C_3F_8$) are mixed at a ratio of 1:1:0.1.

The implantation of ions is preferably performed from the surface side on which the sliding member contacts with the contacted member. For example, in the case of the cleaning blade 342 shown in FIG. 2, it is preferable that the ions be implanted from the surface contacting with the image holding member (photoconductor drum) 31, that is, the side of the tip end surface 3B.

Thickness

It is preferable that the thickness of the carbon-containing region from the side of the contact surface of the contacted member be 0.1 μm to 50 μm.

When the thickness of the carbon-containing region is greater than or equal to 0.1 μm, it is preferable in terms of obtaining a required low sliding property. In contrast, when the thickness thereof is less than or equal to 5.0 μm, it is preferable in terms of preventing damage at the time of collision with foreign matters by maintaining toughness (viscoelasticity) as a resin (rubber) of the carbon-containing region.

The thickness of the carbon-containing region is controlled by adjusting applied voltage, electric current, the number of repetitive pulses, the pulse width, the delay time, and the like when implanting ions as described above, for example.

As the thickness of the carbon layer, 0 nm to 500 nm is preferable, 10 nm to 200 nm is more preferable, 10 nm to 100 nm is even more preferable.

When the thickness of the carbon-containing region is less than or equal to 500 nm, it is preferable in terms of preventing scratches on the contacted member due to separated pieces contacting with the contacted member since separated pieces are hardly generated even when peeling of the carbon layer occurs.

The thickness of the carbon layer is controlled by adjusting the time of implanting ions, for example.

Application

The sliding member of the exemplary embodiment is suitably used as a cleaning blade, for example. A member to be cleaned by the cleaning blade is not particularly limited as long as the surface of the member requires cleaning. Examples thereof include an image holding member (photoconductor), an intermediate transfer member, a charging roll, a transfer roll, a transferred material-transporting belt, a paper feeding roll, and a detoning roll for further removing toner from a cleaning brush which removes toner from the image holding member.

In addition, the sliding member of the exemplary embodiment is not particularly limited as long as the sliding member is disposed so as to contact with other members in the image forming apparatus in addition to the cleaning blade and slides, and may be used in every member. Examples of the other application include a surface of a rotating roller, a surface of a recording medium feeding path, a surface of airtight packing, a surface of a sliding pad, and a sheet.

(Cleaning Device, Process Cartridge, and Image Forming Apparatus)

Next, a cleaning device, a process cartridge, and an image forming apparatus in which the sliding member of the exemplary embodiment is used as the cleaning blade will be described.

The cleaning device of an exemplary embodiment is not particularly limited as long as the cleaning device is provided with the sliding member of the exemplary embodiment as a cleaning blade which contacts with a surface of a member to be cleaned and cleans the surface of the member to be cleaned. Examples of the configuration example of the cleaning device include a configuration in which the cleaning blade is fixed to the inside of a cleaning case which has an opening on a side of a member to be cleaned such that a tip end of an edge becomes the opening side, and which is provided with a transporting member that guides foreign matters such as waste toner collected from the surface of the member to be cleaned by the cleaning blade to a container for collecting foreign matters. In addition, two or more cleaning blades of the exemplary embodiment may be used in the cleaning device of the exemplary embodiment.

When using the cleaning blade of the exemplary embodiment for clanging an intermediate transfer member of an intermediate transfer belt or the like, the force NF (normal force) with which the cleaning blade is pressed by the intermediate transfer member is preferably within a range of 1.2 gf/mm to 3.0 gf/mm and is more preferably within a range of 1.6 gf/mm to 2.5 gf/mm.

In addition, the length in which the tip end portion of the cleaning blade bites into the intermediate transfer member is preferably within a range of 0.6 mm to 2.0 mm and more preferably within a range of 0.9 mm to 1.4 mm.

The angle W/A (working angle) in the contact portion between the cleaning blade and the intermediate transfer member is preferably within a range of 8° to 14° and more preferably within a range of 10° to 12°.

In contrast, the process cartridge of an exemplary embodiment is not particularly limited as long as the process cartridge contacts with the surface of one or more members to be cleaned such as the image holding member or the intermediate transfer member and is provided with the cleaning device of the exemplary embodiment as a cleaning device which cleans the surface of the members to be cleaned. For example, a mode in which the process cartridge includes the intermediate transfer member and the cleaning device of the exemplary embodiment which cleans the surface of the intermediate transfer member and is detachable from the image forming apparatus. Moreover, a cleaning brush or the like may be used in combination in addition to the cleaning device of the exemplary embodiment.

Specific Examples of Image Forming Apparatus and Cleaning Device

Next, specific examples of the cleaning blade of the exemplary embodiment, and an image forming apparatus and a cleaning device using the same will be described in detail with reference to the accompanying drawings.

Figure 4:
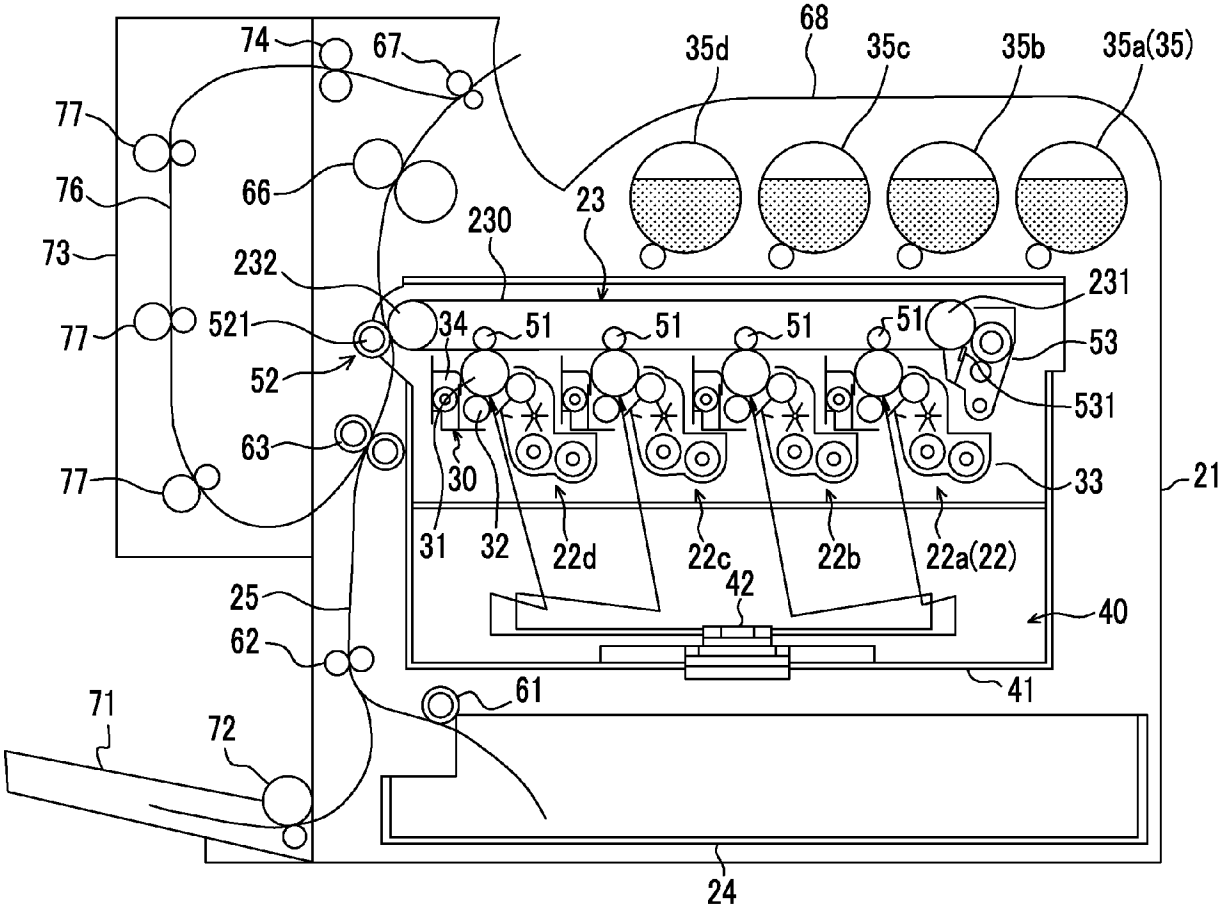
FIG. 4 is a schematic view showing an example of an image forming apparatus according to an exemplary embodiment.

FIG. 4 is a schematic view showing an example of an image forming apparatus according to an exemplary embodiment, which represents a so-called tandem image forming apparatus.

In FIG. 4, 21 represents a main body housing, 22 and 22*a* to 22*d* represent image forming units, 23 represents a belt module, 24 represents a recording medium supply cassette, 25 represents a recording medium feeding path, 30 represents each photoconductor unit, 31 represents a photoconductor drum, 33 represents each developing unit, 34 represents a cleaning device, 35 and 35*a* to 35*d* represent toner cartridges, 40 represents an exposure unit, 41 represents a unit case, 42 represents a polygon mirror, 51 represents a primary transfer device, 52 represents a secondary transfer device, 53 represents a belt cleaning device, 61 represents a delivery roll, 62 represents a feeding roll, 63 represents a positioning roll, 66 represents a fixing device, 67 represents an exit roll, 68 represents a discharge unit, 71 represents a manual feed supply device, 72 represents a delivery roll, 73 represents a duplex recording unit, 74 represents a guide roll, 76 represents a feeding path, 77 represents a feeding roll, 230 represents an intermediate transfer belt, 231 and 232 represent support rolls, 521 represents a secondary transfer roll, and 531 represents a cleaning blade.

The tandem image forming apparatus shown in FIG. 4 is an apparatus in which image forming units 22 (in specific, 22*a* to 22*d*) for four colors (in the exemplary embodiment, yellow, magenta, cyan, and black) are arranged within a main body housing 21; a belt module 23, which includes an intermediate transfer belt 230 circulated and transported along an arrangement direction of each of the image forming units 22, is disposed on the image forming units; a recording medium supply cassette 24, in which recording media (not shown) such as sheets are accommodated, is disposed below the main body housing 21; and a recording medium feeding path 25, which becomes a feeding path for recording media from the recording medium supply cassette 24, is disposed in a vertical direction.

In the exemplary embodiment, each of the image forming units 22 (22*a* to 22*d*) forms toner images of, for example, yellow, magenta, cyan, and black, in order from an upstream side in the circulation direction of the intermediate transfer belt 230 (the arrangement is not necessarily limited to this order), and is provided with each photoconductor unit 30, each developing unit 33, and one common exposure unit 40.

Here, the photoconductor unit 30 is a unit in which, for example, a photoconductor drum 31, a charging device (charging roll) 32 that previously charges the photoconductor drum 31, and a cleaning device 34 that removes residual toner on the photoconductor drum 31 are integrally formed as a sub-cartridge.

In addition, the developing unit 33 develops an electrostatic latent image, which is exposed and formed by the exposure unit 40, on the charged photoconductor drum 31 using corresponding color toners (in the exemplary embodiment, for example, negative polarity), and is integrated with the sub-cartridge consisting of, for example, the photoconductor unit 30 to configure a process cartridge (so-called customer replaceable unit).

As a matter of course, the photoconductor unit 30 may be separated from the developing unit 33 as an independent process cartridge. In addition, in FIG. 4, the reference numeral 35 (35*a* to 35*d*) is a toner cartridge for replenishing each color component toner to each developing unit 33 (the toner replenishing path is not shown).

In contrast, the exposure unit 40 is a unit in which, for example, four semiconductor lasers (not shown), one polygon mirror 42, an imaging lens (not shown), and mirrors (not shown) respectively corresponding to the photoconductor units 30 are stored in the unit case 41; and light beams from the semiconductor lasers per color component are subjected to deflected scanning by the polygon mirror 42 and are disposed such that light images are guided to an exposure point on the corresponding photoconductor drum. 31 through the imaging lens and the mirrors.

In addition, in the exemplary embodiment, a belt module 23 is a module in which the intermediate transfer belt 230 is bridged between a pair of support rolls (one of which is driving roll) 231, 232. A primary transfer device (in this example, a primary transfer roll) 51 is disposed on a back surface of the intermediate transfer belt 230 corresponding to the photoconductor drum 31 of each photoconductor unit 30. A toner image on the photoconductor drum 31 is electrostatically transferred on the intermediate transfer belt 230 side by applying a voltage having reverse polarity to the charging polarity of toner to the primary transfer device 51. Furthermore, a secondary transfer device 52 is disposed in a part corresponding to the support roll 232 on a downstream side of the image forming unit 22*d* on the most downstream side of the intermediate transfer belt 230, and a primary transfer image on the intermediate transfer belt 230 is secondarily transferred (collectively transferred) to a recording medium.

In the exemplary embodiment, the secondary transfer device 52 is provided with a secondary transfer roll 521 which is arranged so as to be in pressure-contact with a toner image holding surface of the intermediate transfer belt 230, and a back surface roll (which also functions as the support roll 232 in this example) which forms a counter electrode of the secondary transfer roll 521 disposed on a backside of the intermediate transfer belt 230. For example, the secondary transfer roll 521 is grounded, and bias having the same polarity as the charging polarity of toner is applied to the back surface roll (support roll 232).

In addition, a belt cleaning device 53 is disposed on an upstream side of the image forming unit 22*a* on the most upstream side of the intermediate transfer belt 230 and removes residual toner on the intermediate transfer belt 230. The cleaning blade of the exemplary embodiment is used as the cleaning blade 531 used in the belt cleaning device 53.

In addition, a delivery roll 61 which delivers a recording medium is provided on the recording medium supply cassette 24. A feeding roll 62 which delivers the recording medium is disposed immediately after the delivery roll 61 and a registration roll (positioning roll) 63, which supplies the recording medium to a secondary transfer part at a determined timing, and is disposed on the recording medium feeding path 25 positioned immediately before the secondary transfer part. In contrast, the fixing device 66 is provided in the recording medium feeding path 25 positioned on a downstream side of the secondary transfer part, the exit roll 67 for discharging the recording medium is provided on the downstream side of a fixing device 66, and the discharged recording medium is housed in a discharge unit 68 formed on the top of a main body housing 21.

Furthermore, in the exemplary embodiment, a manual feed supply device (MSI) 71 is provided on the side of the main body housing 21. A recording medium on the manual feed supply device 71 is delivered toward the recording medium feeding path 25 by the delivery roll 72 and the feeding roll 62.

In addition, a duplex recording unit 73 is attached to the main body housing 21. When a duplex mode in which image recording is performed on both surfaces of a recording medium, the duplex recording unit 73 reverses the one-side recorded recording medium using the exit roll 67 and taking it into the inside of the duplex recording unit using a guide roll 74 near the entrance of the duplex recording unit, transports the recording medium along a recording medium return feeding path 76 inside the duplex recording unit using the feeding roll 77, and supplies the recording medium to the positioning roll 63 side again.

Next, the cleaning device 34 disposed inside the tandem image forming apparatus shown in FIG. 4 will be described in detail.

Figure 5:
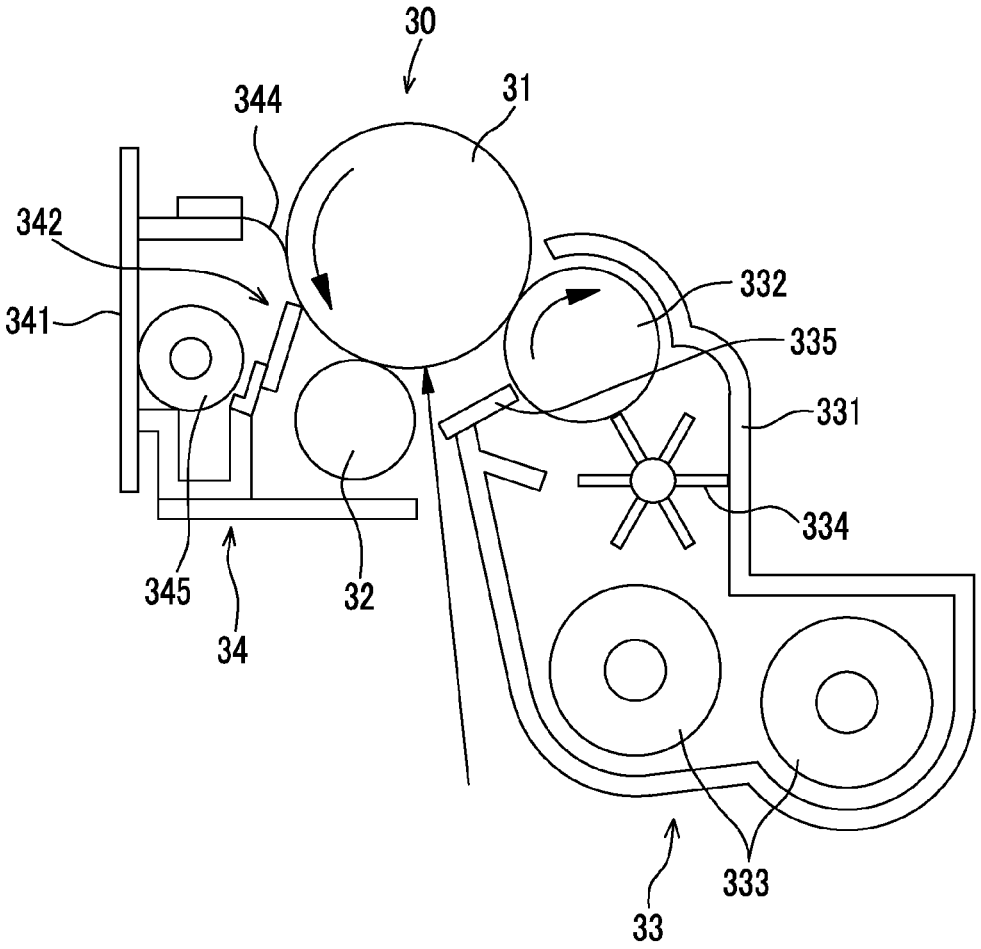
FIG. 5 is a schematic cross-sectional view showing an example of a cleaning device according to an exemplary embodiment.

FIG. 5 is a schematic cross-sectional view showing an example of a cleaning device according to an exemplary embodiment, and is a view in which the photoconductor drum 31 and the charging roll 32 which are formed as a sub-cartridge together with the cleaning device 34, and the developing unit 33, which are shown in FIG. 4, are shown.

In FIG. 5, 32 represents a charging device (charging roll), 331 represents a unit case, 332 represents a developing roll, 333 represents a toner transporting member, 334 represents a transporting belt, 335 represents a developer quantity regulating member, 341 represents a cleaning case, 342 represents a cleaning blade, 344 represents a film seal, and 345 represents a transporting member.

The cleaning device 34 has a cleaning case 341 in which residual toner is accommodated and which is opened opposite to the photoconductor drum 31. A cleaning blade 342 which is disposed so as to contact with the photoconductor drum 31 is attached to a lower edge of the opening of the cleaning case 341 through a bracket (not shown). Meanwhile, a film seal 344 by which the space between the photoconductor drum 31 and the cleaning case is airtightly maintained is attached to an upper edge of the opening of the cleaning case 341. The reference numeral 345 is a transporting member which guides waste toner accommodated in the cleaning case 341 to a waste toner container.

In the exemplary embodiment, in every cleaning device 34 of each image forming unit 22 (22*a* to 22*d*), the cleaning blade of the exemplary embodiment may be used as the cleaning blade 342. In addition, the cleaning blade of the exemplary embodiment may also be used as the cleaning blade 531 used in the belt cleaning device 53.

In addition, the developing unit (developing device) 33 used in the exemplary embodiment has, for example, a unit case 331 in which developer is accommodated and which is opened opposite to the photoconductor drum 31 as shown in FIG. 5. Here, a developing roll 332 is disposed at a portion facing the opening of the unit case 331, and a toner transporting member 333 for stirring and transporting the developer is disposed in the unit case 331. Furthermore, a transporting belt 334 is disposed between the developing roll 332 and the toner transporting member 333.

During developing, developer is supplied to the developing roll 332, and then, is transported to a developing region opposite to the photoconductor drum. 31 in a state where the thickness of the layer of the developer is regulated by a developer quantity regulating member 335, for example.

A two-component developer formed of toner and a carrier is used as the developing unit 33 in the exemplary embodiment. However, it is also acceptable to use a single-component developer formed of only toner.

Next, the operation of the image forming apparatus according to an exemplary embodiment will be described. First, when each image forming unit 22 (22*a* to 22*d*) forms a monochromatic toner image corresponding to each color, the formed toner images are sequentially overlapped and primarily transferred on the surface of the intermediate transfer belt 230 so as to be coincident with the original information. Next, the color toner images which are transferred on the surface of the intermediate transfer belt 230 are transferred on the surface of a recording medium using the secondary transfer device 52, and the recording medium on which the color toner images are transferred is discharged to the discharge unit 68 after being subjected to a fixing treatment using the fixing device 66.

Meanwhile, in each image forming unit 22 (22*a* to 22*d*), residual toner on the photoconductor drum 31 is cleaned by the cleaning device 34, and residual toner on the intermediate transfer belt 230 is cleaned by the belt cleaning device 53.

The residual toner is cleaned by each of the cleaning device 34 and the belt cleaning device 53 in such an image forming process.

The cleaning blade 342 may be fixed through a spring material unlike the cleaning blade directly fixed to the film member within the cleaning device 34 as shown in FIG. 5.

EXAMPLES

Hereinafter, the invention will be described with reference to the examples, but is not limited to only the examples. The "parts" in the following description means "parts by weight".

Example 1

Manufacture of Base Material Having No Carbon-Containing Region

First, polycaprolactone polyol (Placcel 205 manufactured by Daicel Chemical Industries, Ltd., average molecular weight of 529, and hydroxyl value of 212 KOHmg/g) and polycaprolactone polyol (Placcel 240 manufactured by Daicel Chemical Industries, Ltd., average molecular weight of 4155, and hydroxyl value of 27 KOHmg/g) are used as a soft segment material of the polyol component. In addition, an acrylic resin (Act Flow UMB-2005B manufactured by Soken Chemical Engineering Co., Ltd.) containing two or more hydroxyl groups is used as a hard segment material, and the above-described soft segment material and the hard segment material are mixed at a ratio of 8:2 (weight ratio).

Next, 6.26 parts of 4,4'-diphenylmethane diisocyanate (Millionate MT manufactured by Nippon Polyurethane Industry Co., Ltd.) is added to 100 parts of the mixture of the soft segment material and the hard segment material, as an isocyanate compound, and the mixture is reacted for 3 hours at 70° C. in a nitrogen atmosphere. The amount of the isocyanate compound used in the reaction is selected such that the ratio (isocyanate group/hydroxyl group) of isocyanate groups to hydroxyl groups contained in the reaction system becomes 0.5.

Subsequently, 34.3 parts of the above-described isocyanate compound is added thereto, and the mixture is reacted for 3 hours at 70° C. to obtain a prepolymer. The total amount of the isocyanate compound used for obtaining the prepolymer is 40.56 parts.

Next, the temperature of the prepolymer is raised to 100° C. and the prepolymer is defoamed for one hour under reduced pressure. Then, 7.14 parts of a mixture (weight ratio=60/40) of 1,4-butanediol and trimethylolpropane is added to 100 parts of the prepolymer, the mixture is mixed for 3 minutes so as not to involve foam therein to prepare abase material-forming composition A.

Next, the above-described base material-forming composition A is poured into a centrifugal molding machine in which the temperature of a mold is adjusted to 140° C. and is subjected to a curing reaction for one hour. Next, the composition is matured and heated for 24 hours at 110° C. and is cut after being cooled to obtain a base material A having a length of 320 mm, a width of 12 mm, and a thickness of 2 mm.

Formation of Carbon-Containing Region and Carbon Layer

A carbon-containing region is formed by implanting carbon ions which have an sp3 bond into a contact side with a contacted member of the base material A, and a carbon layer is formed on the outside (on the contact surface with the contacted member) of the carbon-containing region, through a pulse plasma ion implantation method. Hereinafter, the pulse plasma ion implantation method will be specifically described.

Carbon ions are mostly implanted into the base material A by applying a high voltage pulse (15 kV to 35 kV) to the base material A in plasma of a methane gas. Accordingly, the carbon ions cuts the bond between carbon atoms or the bond between carbon and hydrogen of the base material A formed of rubber, and are substituted with carbon or hydrogen in the rubber. As a result, a carbon-containing region into which carbon atoms are implanted up to a depth of at least greater than or equal to 0.1 μm from the base material A.

Here, in order to enhance penetration of the carbon-containing region, the gas pressure is increased (within a range of 0.5 Pa to 2 Pa), and the number of repetitions of the high voltage pulse is increased as possible (2000 pps to 10000 pps). Next, a low voltage pulse (2 kV to 5 kV) to be applied is applied to a packing main body at least once in plasma of a methane gas. Accordingly, a carbon layer is formed on the surface of the carbon-containing region of the base material A. A surface adjusting process using pulse plasma may be provided before the above-described ion implantation process.

Reference Example 1

The base material A manufactured in Example 1 is used as it is without forming a carbon-containing region and a carbon layer.

Comparative Example 1

The base material A manufactured in the example 1 is not formed with a carbon-containing region and a carbon layer, and a curing treatment is subjected to the contact side with the contacted member using isocyanate. The curing treatment using isocyanate is implemented through the method disclosed in paragraphs [0039] to [0049] of JP-A-2013-80077.

The specific process for implementing the curing treatment will be described. As a method of impregnating an isocyanate compound into a base material A, first, the temperature is set to a temperature at which the polyisocyanate compound is in a liquid state, and the base material A is impregnated in the polyisocyanate compound. Similarly, it is preferable that the temperature of the polyisocyanate compound after the impregnation be a temperature at which the polyisocyanate compound is in a liquid state. In this manner, urethane is impregnated in the polyisocyanate compound, and the polyisocyanate compound remaining on the surface of urethane is wiped. Then, the curing treatment is implemented by advancing reaction between the impregnated polyisocyanate compound and the polyurethane rubber.

Comparative Example 2

Pulse plasma ion implantation performed in the example is further performed for the base material, which is manufactured in the comparative example 1 by implementing the curing treatment using isocyanate, to form a carbon-containing region and a carbon layer.

Evaluation Test

Measurement of Hardness Near Contact Angle (Edge) with Contacted Member

The hardness near the edge is measured through the following method.

The hardness is measured using a micro rubber durometer (ASKER MD-1 capa manufactured by Kobunshi Keiki Co., Ltd.) from the surface of the cleaning blade contacting with the contacted member, that is, from the tip end surface 3B side.

Chipping Test

The number of cycles is measured until the chipping is generated by performing the following the following test.

The presence and absence of the generation of the chipping is reviewed using a turntable type impact testing machine on which a sheet with iron powder being evenly dispersed on a polyimide resin is stuck is examined. The number of rotations of the turntable is set to 309 mm/sec, the load during the contact of the blade with the contacted member is set to 3 gf/mm, and the contact angle is set to 21 degrees. After 300 cycles, chipping is caused in the comparative examples 1 and 2 whereas chipping is not caused in the example 1 and the reference example 1.

It is presumed that the hardness of the base material of the example 1 being higher than that of the reference example 1 and the hardness of the base material of the comparative example 1 being higher than that of the comparative example 2 even though the material of the base material is the same as each other is because of the presence and absence of the carbon-containing region.

The sliding member of the example 1 is equipped as the cleaning blade in an image forming apparatus (image forming apparatus in which the process speed of 700 Disital Color Press (trade name) manufactured by Fuji Xerox Co., Ltd. is converted to a high speed), and the surface of the sliding member after being used in an unused state and under actual use conditions is observed using an optical microscope (VK 9500 manufactured by Keyence Corporation). There is no crack on the carbon layer of the unused product. However, there is a crack and chipping caused on the carbon layer after being used. However, favorable cleaning is maintained during print even if a lubricant is not initially applied to the contact surface (tip end surface), and turned-up of the blade does not occur even after forming 50000 images.

In contrast, in the blade formed of only rubber which is not subjected to ion implantation (reference example 1), turned-up of the blade occurs in high-temperature and high-humidity environment (30° C. and 80% RH).

In addition, in the blade which is subjected to the curing treatment using isocyanate (comparative example 1), chipping is generated during low image-continuous traveling and cleaning failures occur.

From the above-described result, according to the sliding member according to the examples, it is found that a low sliding property between the sliding member and the contacted member may be obtained and the generation of chipping may be prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sliding member for image formation which is disposed so as to slide while contacting with at least a contacted member in an image forming apparatus, comprising:

a base material, the entirety of which contains a resin and which further has a carbon-containing region containing

TABLE 1

| | Blade | Base material | Carbon-containing region | Isocyanate curing treatment | Hardness (degree) | Cycle test (generation of chipping) |
|---|---|---|---|---|---|---|
| Example 1 | Blade 1 | Base material A | Yes | Undone | 82 | Absence |
| Reference Example 1 | Blade 2 | Base material A | None | Undone | 76 | Absence |
| Comparative Example 1 | Blade 3 | Base material A | None | Done | 90 | Presence |
| Comparative Example 2 | Blade 4 | Base material A | Yes | Done | 95 | Presence |

carbon, which has an sp3 bond, on a contact side with the contacted member, and in which a region other than the carbon-containing region is formed of an identical material, wherein the sliding member satisfies any one of the requirements of the following (A) and (B):

(A) the carbon-containing region configures a contact portion with the contacted member; and (B) the sliding member is provided with a carbon layer which does not contain a resin but contains carbon having an sp3 bond on a surface further on the contact side with the contacted member of the carbon-containing region and configures a contact portion with the contacted member.

2. A sliding member for image formation which is disposed so as to slide while contacting with at least a contacted member in an image forming apparatus, comprising:

a base material, the entirety of which contains a resin having no crosslinking structure by isocyanate, and which further has a carbon-containing region containing carbon, which has an sp3 bond, on a contact side with the contacted member, wherein the sliding member satisfies any one of requirements of the following (A) and (B):

(A) the carbon-containing region configures a contact portion with the contacted member; and (B) the sliding member is provided with a carbon layer which does not contain a resin but contains carbon having an sp3 bond on a surface further on the contact side with the contacted member of the carbon-containing region and configures a contact portion with the contacted member.

3. The sliding member for image formation according to claim 1, wherein the sliding member satisfies the requirement of the above-described (B).

4. The sliding member for image formation according to claim 2, wherein the sliding member satisfies the requirement of the above-described (B).

5. The sliding member for image formation according to claim 1, wherein a thickness of the carbon layer is less than or equal to 500 nm.

6. The sliding member for image formation according to claim 2, wherein a thickness of the carbon layer is less than or equal to 500 nm.

7. The sliding member for image formation according to claim 3, wherein a thickness of the carbon layer is less than or equal to 500 nm.

8. The sliding member for image formation according to claim 4, wherein a thickness of the carbon layer is less than or equal to 500 nm.

9. The sliding member for image formation according to claim 1, wherein the resin contained in the base material is rubber having a JIS-A hardness of less than or equal to 85 degrees.

10. The sliding member for image formation according to claim 2, wherein the resin contained in the base material is rubber having a JIS-A hardness of less than or equal to 85 degrees.

11. The sliding member for image formation according to claim 3, wherein the resin contained in the base material is rubber having a JIS-A hardness of less than or equal to 85 degrees.

12. The sliding member for image formation according to claim 4, wherein the resin contained in the base material is rubber having a JIS-A hardness of less than or equal to 85 degrees.

13. The sliding member for image formation according to claim 5, wherein the resin contained in the base material is rubber having a JIS-A hardness of less than or equal to 85 degrees.

14. The sliding member for image formation according to claim 6, wherein the resin contained in the base material is rubber having a JIS-A hardness of less than or equal to 85 degrees.

15. The sliding member for image formation according to claim 7, wherein the resin contained in the base material is rubber having a JIS-A hardness of less than or equal to 85 degrees.

16. The sliding member for image formation according to claim 8, wherein the resin contained in the base material is rubber having a JIS-A hardness of less than or equal to 85 degrees.

17. The sliding member for image formation according to claim 1, wherein the sliding member is a cleaning member which cleans a surface of the contacted member while contacting with the contacted member.

18. A cleaning device comprising:

the sliding member for image formation according to claim 17 as a cleaning member.

19. A process cartridge comprising:

the cleaning device according to claim 18, wherein the process cartridge is detachable from an image forming apparatus.

20. An image forming apparatus comprising:

an image holding member;

a charging device that charges the image holding member;

an electrostatic latent image formation device that forms an electrostatic latent image on a surface of a charged image holding member;

a developing device which develops the electrostatic latent image formed on the surface of the image holding member using toner to form a toner image;

an intermediate transfer member on which the toner image formed on the image holding member is transferred;

a primary transfer device which primarily transfers the toner image formed on the image holding member on a surface of the intermediate transfer member;

a secondary transfer device which secondarily transfers the toner image transferred on the intermediate transfer member on a recording medium; and the cleaning device according to claim 18 which performs cleaning by bringing the sliding member for image formation into contact with the surface of the intermediate transfer member after the toner image is transferred by the secondary transfer device.

* * * * *